United States Patent [19]

Greenberg

[11] Patent Number: 4,955,846

[45] Date of Patent: Sep. 11, 1990

[54] BRASSIERE WITH SIZE AND CONFIGURATION ADJUSTMENT MECHANISM

[76] Inventor: Bert Greenberg, 2030 S. Ocean Dr., Hallandale, Fla. 33009

[21] Appl. No.: 405,545

[22] Filed: Sep. 11, 1989

[51] Int. Cl.[5] ..... A41C 3/00

[52] U.S. Cl. ..... 450/69; 450/67; 450/68; 2/73

[58] Field of Search ..... 2/67, 71, 72, 73, 74, 2/104, 105, 106, 110; 450/67, 68, 69

[56] References Cited

U.S. PATENT DOCUMENTS

| | | | |
|---|---|---|---|
| Re. 24,640 | 4/1959 | Hunau | 450/69 |
| 1,718,033 | 6/1929 | Cunningham | 450/68 |
| 2,042,924 | 6/1936 | Cunningham | 2/67 |
| 2,706,816 | 4/1955 | Dozier | 2/104 X |
| 2,725,563 | 12/1955 | Rich | 450/68 |
| 2,897,821 | 8/1959 | Lerner | 2/67 X |
| 2,963,023 | 12/1960 | Clover | 450/67 X |
| 3,083,737 | 4/1963 | De Mestral | 139/46 |
| 4,031,900 | 6/1977 | Guidoni | 2/67 X |
| 4,289,137 | 9/1981 | Dell et al. | 2/67 X |
| 4,444,192 | 4/1984 | Stern et al. | 450/67 |

FOREIGN PATENT DOCUMENTS

| | | | |
|---|---|---|---|
| 0984687 | 7/1951 | France | 450/69 |
| 1014291 | 8/1952 | France | 450/69 |

OTHER PUBLICATIONS

Maurice Gershman, "Self Adhering Nylon Tapes", The J.A.M.A., vol. 168, No. 7, p. 930, dated: Oct. 1958.

*Primary Examiner*—Werner H. Schroeder
*Assistant Examiner*—Jeanette E. Chapman
*Attorney, Agent, or Firm*—McAulay Fisher Nissen & Goldberg

[57] ABSTRACT

A brassiere is disclosed having a size and configuration adjustment mechanism which includes a separable fastener having first and second linear elements. The first element is attached to the vertical centerline of the brassiere. The second element has a fixed end and a free end, with the fixed end attached to the brassiere at a position along the centerline of the garment. The second element of the fastener is connectable at selected locations along the first element of the fastener to affect the vertical height of the centerline of the brassiere, whereby the selective positioning of the second element along the first element reduces the cup size in both the vertical and horizontal directions.

5 Claims, 2 Drawing Sheets

BRASSIERE WITH SIZE AND CONFIGURATION ADJUSTMENT MECHANISM

BACKGROUND OF THE INVENTION

I. Field of the Invention

This invention relates generally to a brassiere and, more specifically, to a brassiere having a size and adjustment mechanism.

II. Description of the Prior Art

Brassieres are marketed by specific size. For example, a size 34B bra denotes a chest size of 34 inches (86.36 cm) and a breast or cup size arbitrarily denoted by the letter "B". A higher letter in the bra size denotes a larger bust. Stores that sell foundation garments, such as brassieres, are often required to maintain a large inventory of such garments, due to the widely different sizes and configurations of the female anatomy, in order to properly service their customers.

Even where two women wear the same size bra, it would be unusual for them to have exactly the same body configuration. Indeed, a size 34B bra of one manufacturer may fit a woman perfectly while the same size bra of another manufacturer will not.

In reality, most bras do not fit the wearer perfectly. Some so-called lifting adjustment is possible by adjusting the length of the shoulder straps. In other instances, the engagement of the fastening hooks and loops on the back panels is adjustable. These adjustments are intended to compensate for differences in body configurations even for women who wear the same bra size.

The present invention provides a novel size and adjustment mechanism for a brassiere which will permit a given size bra to be adjustable, both in chest size and cup size, to accommodate a plurality of bra sizes, within a given range, in the manner hereinafter described.

SUMMARY OF THE INVENTION

The brassiere of the present invention provides for an adjustment mechanism including a separable fastener having first and second linear elements. One of the elements is attached to the vertical centerline of the brassiere, between the two breast cups, at the outer surface and the inner surface of the garment. The other or second element has a fixed end and a free end, with the fixed end being attached to the inner surface of the brassiere at a position near the lower end of the centerline of the garment. An opening is formed at the lower end of the centerline adjacent to the position where the fixed end of the second element is attached to the brassiere. In use, the free end of the second element extends through the centerline opening to permit the second element of the fastener to be connected at selected locations along the first element of the fastener thereby to affect the vertical height of the centerline of the brassiere.

Specifically, by pulling the second element upwardly, there is a gathering of the brassiere along the vertical centerline which imparts a lifting action to the brassiere. The higher the element is pulled, the more the brassiere is lifted. The length of the second element is such that the free end may be positioned to fold over the top edge of the centerline and connect with the first element at the inner surface of the brassiere.

This has the effect of pulling down on the centerline of the brassiere to create a plunging neckline. Such positioning of the second element exerts forces on the brassiere which reduces the body size in a horizontal direction and the cup size in both the vertical and horizontal directions to enable a brassiere of a given bra size to accommodate a wide range of smaller breast and body sizes.

Additional features and advantages of the present invention will become more apparent from a consideration of the following detailed description when taken in conjunction with the accompanying drawings.

DESCRIPTION OF THE PREFERRED EMBODIMENT

Figure 1:
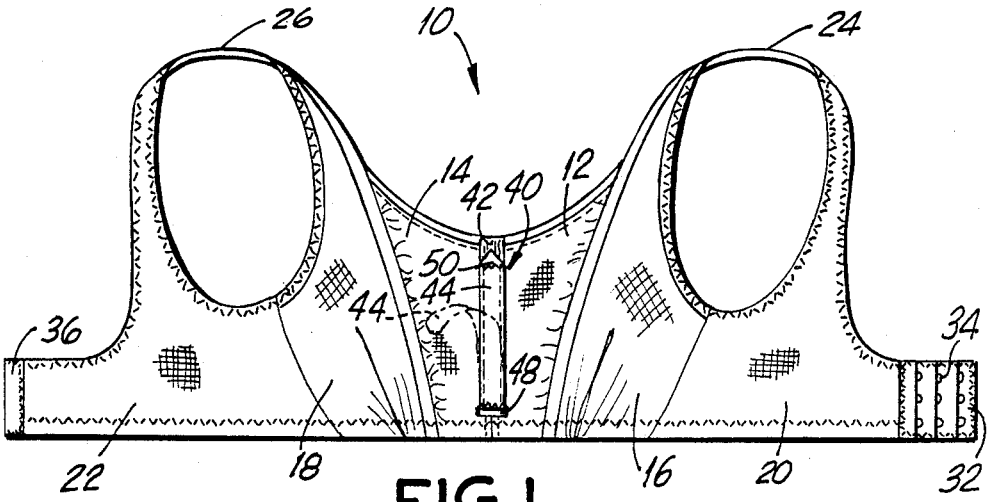
FIG. 1 is a front elevational view of a brassiere constructed in accordance with the present invention.
Figure 2:
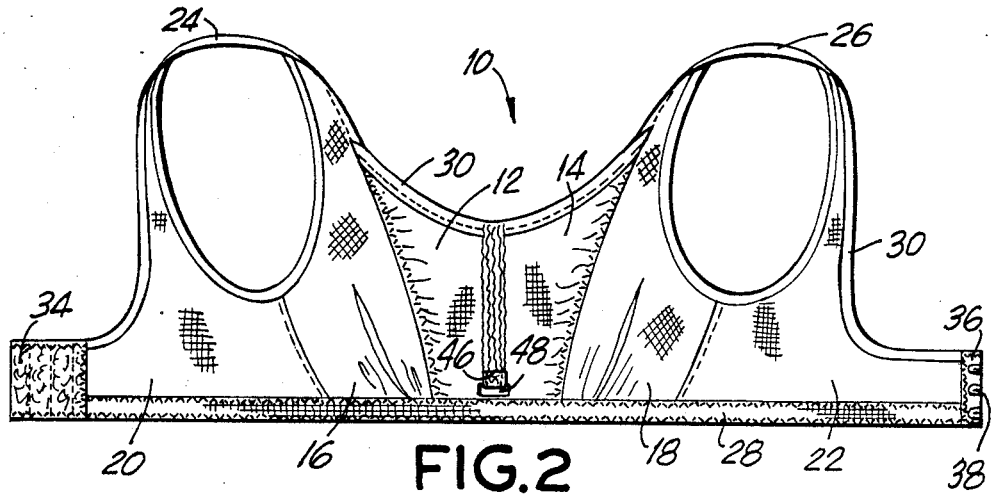
FIG. 2 is a back elevational view of the brassiere shown in FIG. 1.
Figure 3:
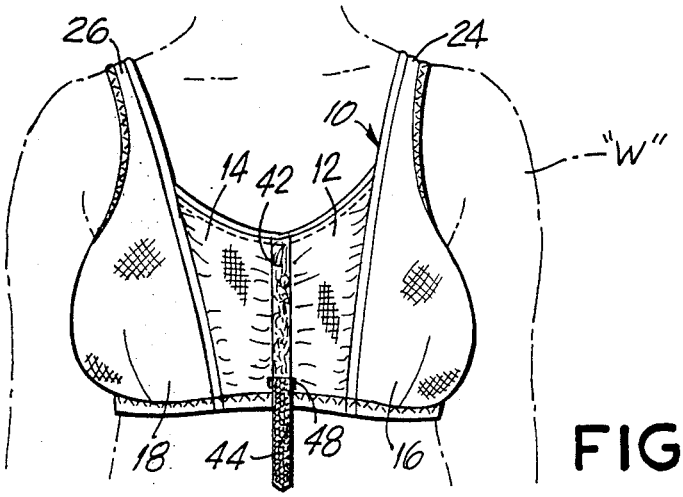
FIG. 3 is a diagrammatic view of the brassiere of FIG. 1 being worn by the wearer with the size and configuration adjustment mechanism in an unfastened state.

Referring to the drawings, numeral 10 represents a brassiere constructed in accordance with the present invention. Brassiere 10 includes front panels 12 and 14 joined along a vertical centerline of the garment, and also joined to spaced-apart breast cup panels 16 and 18, respectively. A pair of combined side and back panels 20 and 22 are joined, respectively, to the breast cup panels 16 and 18. The breast cup panels 16 and 18 and the side/back panels 20 and 22 merge upwardly to form shoulder straps 24 and 26. All of the panels and the shoulder straps are preferably made of an elastic material as is well known in the art. A lower, body-encircling band 28 is joined to the lower edges of the front panels 12 and 14, breast cup panels 16 and 18 and the side/back panels 20 and 22 by suitable stitching in conventional manner. Similarly, an upper band 30 is joined to the upper edges of front panels 12 and 14, and the side/back panels 20 and 22. The upper and lower bands 28 and 30 also are constructed of elastic material as is well known in the art.

Brassiere 10 further comprises a back panel catch or hook arrangement which includes a band 32 connected to back panel 20 and having rows of vertically oriented eyelets 34. Connected to the end of back panel 22 is a band 36 having a row of vertically oriented hooks 38. The arrangement is such that selected eyelets 34 are adapted to receive the hooks 38 for assembling brassiere 10 to the body of the wearer "W".

In accordance with the present invention, brassiere 10 includes a size and configuration adjustment mechanism represented generally by numeral 40. In an operative sense, mechanism 40 includes a separable fastener having first and second linear elements 42 and 44, respectively. Element 42 is an elongated strip of fabric material having loops formed on its outer surface. Strip element 42 is attached to the brassiere along the vertical centerline of the garment and extends continuously along the outer surface of the brassiere and the inner surface of the brassiere.

Element 44 comprises a strip of fabric material having hooks disposed along its inner surface. Strip element 44 has one end attached preferably to the inner surface of the brassiere at a position near the lower end of the centerline. In assembly, the fixed end 46 of strip 44 can be attached to the lower end of strip 42 on the inner surface of the brassiere.

Brassiere 10 also is constructed having an opening 48 at the lower end of the centerline of the garment. Opening 48 is disposed to be adjacent to the position where the fixed end 46 of strip 44 is attached to the brassiere. The arrangement is such that the free end 50 of strip 44 extends through opening 48 and then may be connected to strip 42 at selected locations along the length of strip 42.

Figure 4:
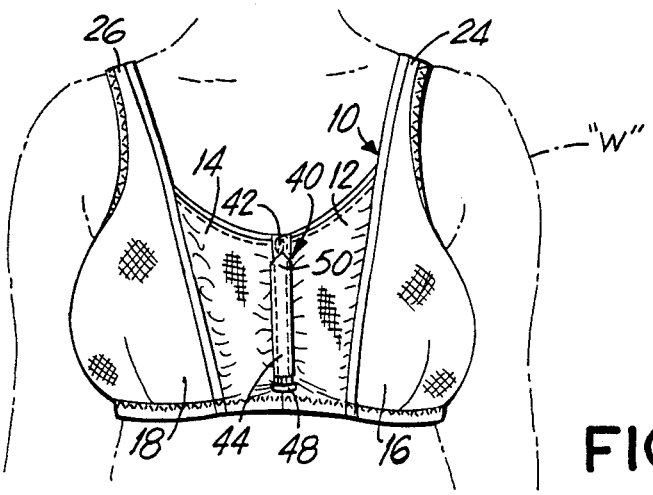
FIG. 4 is a view similar to FIG. 3 with the adjustment mechanism in a fastened state to effect a slight lifting action to the brassiere.

Specifically, FIGS. 1 and 4 show strip 44 overlying and being connected to strip 42 by means of the interengaging hook and loop fasteners of the respective strips. The width of strips 42 and 44 are substantially the same. For purposes of appearance, the outer surface of strip 44 has a satin finish. Each of the strips 42 and 44 is relatively thin so as not to be unsightly and not interfer with the comfort of the garment when worn.

Figure 5:
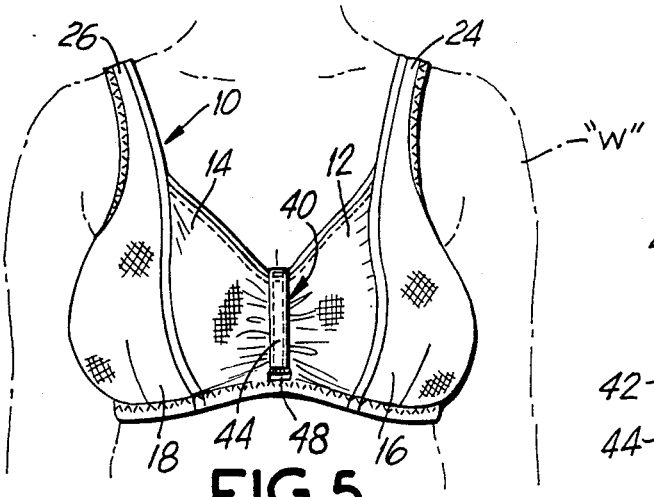
FIGS. 5 and 6 are views similar to FIG. 4 showing the adjustment mechanism fastened at selected locations to successively increase the lifting action of the brassiere and to create a plunging neckline.
Figure 6:
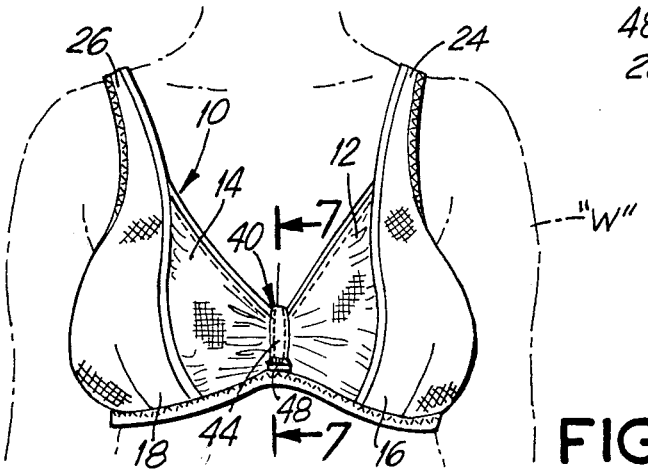

FIGS. 4 through 6 show different stages in the adjustment sequence. For example, FIG. 4 shows strip element 44 pulled slightly upwardly and positioned in overlying fastening engagement with strip 42. This has effect of gathering slightly the front panels 12 and 14 to effect a lifting action on the garment. This, in turn, enables the wearer to reduce slightly the body size and cup size to provide a more comfortable fit in the event the wearer's breasts did not entirely fill the cups. Of course, if the brassiere originally was a perfect fit, strip 44 would be positioned without any pulling effect to avoid any such lifting action and gathering of front panels 12 and 14.

Figure 7:
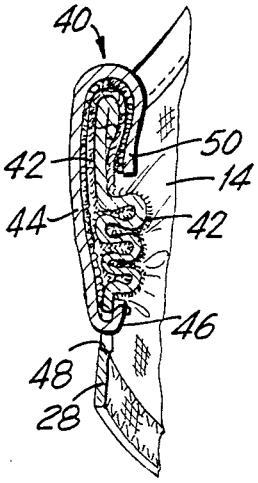
FIG. 7 is a sectional view taken along line 7—7 of FIG. 6.

In those instances where the wearer wishes to lift the garment further, strip 44 may be pulled or lifted upwardly to position the free end 50 in a folded-over position along the centerline of the garment thereby to connect the free end 50 with the strip 42 at the inner surface of the brassiere. This is illustrated in FIGS. 6 and 7. As will be appreciated, the folding over of strip 44 induces a lowering in band 30 to produce a plunging neckline effect. The positioning of strip 44 on strip 42 at selected locations illustrated in FIGS. 4–6 has the effect of exerting forces which successively reduces the body size in a horizontal direction and the cup size in both the vertical and horizontal directions to enable the same brassiere of a given bra size to accommodate a wide range of smaller breast and body sizes.

For example, it has been found that a garment normally designated as bra size 38D can be worn by other women who would normally wear bra sizes 38C, 36DD, and 36D. As a result, one bra constructed having the size and configuration adjustment mechanism disclosed herein can accommodate four or more different bra sizes. This significantly reduces the amount of inventory that need be carried by stores and boutiques that sell such garments.

The effect in creating a plunging neckline also is useful when wearing an outer garment which also has a plunging neckline so as to reduce the likelihood of the upper band 30 being exposed to view when the outer garment is worn.

There is thus provided a novel brassiere construction that enables the wearer to obtain an essentially perfect fit which is achieved by having the breasts completely fill the cup panels thereby providing increased comfort and support. In view of the gathering effect imparted to front panels 12 and 14, it will be appreciated that these panels, together with the vertical centerline, must be of flexible construction.

While a preferred embodiment of the invention has been shown and described in detail, it will be readily understood and appreciated that numerous omissions, changes, and additions may be made without departing from the spirit and scope of the invention.

I claim:

1. A brassiere having a flexible vertical centerline between two breast cups, and a size and configuration adjustment mechanism comprising:

a separable fastener having first and second linear elements;

said first element being attached to said brassiere along said vertical centerline;

said second element having a fixed end and a free end, the fixed end being attached to an inner surface of said brassiere at a position along said centerline;

said brassiere having an opening along said centerline;

the free end of said second element extending through said opening; and said second element of said fastener being separably connectable at selected locations along said first element of said fastener to affect the vertical height of said centerline of said brassiere.

2. A brassiere having a flexible vertical centerline between two breast cups, and a size and configuration adjustment mechanism comprising:

a separable fastener having first and second linear elements;

said first element being attached to said brassiere along said vertical centerline at an outer surface of said brassiere and also along said vertical centerline at an inner surface of said brassiere;

said second element having a fixed end and a free end, the fixed end being attached to the inner surface of said brassiere at a position near a lower end of said centerline;

said brassiere having an opening at the lower end of said centerline adjacent to the position where the fixed end of said second element is attached to said brassiere;

said the free end of said second element extending through said opening; and said second element of said fastener being separably connectable at selected locations along said first element of said fastener to affect the vertical height of said centerline of said brassiere;

whereby the selective positioning of said second element along said first element reduces the cup size in both the vertical and horizontal directions.

3. The brassiere of claim 2 wherein the free end of said second element is connectable to said first element at the outer surface of said brassiere.

4. The brassiere of claim 2 wherein said second element extends upwardly along said centerline on the outer surface of said brassiere with the free end thereof connectable to said first element at the inner surface of said brassiere.

5. The brassiere of claim 2 wherein said first and second elements are strips, one of said strips having loop segments and the other one of said strips having hook segments, said hook and loop segments being separably engageable for connecting said strip elements together in overlying relation.

* * * * *